US009487017B2

(12) United States Patent
Ge et al.

(10) Patent No.: US 9,487,017 B2
(45) Date of Patent: Nov. 8, 2016

(54) FLUID EJECTION DEVICE WITH INTEGRATED INK LEVEL SENSOR

(71) Applicant: HEWLETT-PACKARD DEVELOPMENT COMPANY, L.P., Houston, TX (US)

(72) Inventors: Ning Ge, Palo Alto, CA (US); Joseph M. Torgerson, Philomath, OR (US); Patrick Leonard, Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/440,551

(22) PCT Filed: Nov. 30, 2012

(86) PCT No.: PCT/US2012/067225

§ 371 (c)(1),
(2) Date: May 4, 2015

(87) PCT Pub. No.: WO2014/084843

PCT Pub. Date: Jun. 5, 2014

(65) Prior Publication Data

US 2015/0273848 A1 Oct. 1, 2015

(51) Int. Cl.

| | |
|---|---|
| ***B41J 2/175*** | (2006.01) |
| ***B41J 2/045*** | (2006.01) |
| ***B41J 2/14*** | (2006.01) |

(52) U.S. Cl.

CPC ..... *B41J 2/17566* (2013.01); *B41J 2/0458* (2013.01); *B41J 2/04541* (2013.01); *B41J 2/1404* (2013.01); *B41J 2/14129* (2013.01); *B41J 2/1753* (2013.01); *B41J 2/17546* (2013.01); *B41J 2002/14354* (2013.01); *B41J 2002/17579* (2013.01)

(58) Field of Classification Search

CPC ..... B41J 2/17566
USPC ..... 347/7
See application file for complete search history.

(56) References Cited

U.S. PATENT DOCUMENTS

| | | | | |
|---|---|---|---|---|
| 3,949,245 | A * | 4/1976 | Emmons | G11C 19/285 257/245 |
| 5,682,184 | A | 10/1997 | Stephany et al. | |
| 5,721,574 | A * | 2/1998 | Kubby | B41J 2/04541 347/7 |
| 6,264,302 | B1 | 7/2001 | Imanaka et al. | |

(Continued)

FOREIGN PATENT DOCUMENTS

| | | |
|---|---|---|
| JP | 2001-315352 | 11/2001 |
| JP | 2008-273177 | 11/2008 |

(Continued)

OTHER PUBLICATIONS

Velden, M.V.D. et al.; "Characterization of a Nozzle-integrated Capacitive Sensor for Microfluidic Jet Systems"; Oct. 28-21, 2007; pp. 1241-1244; http://ectm.ewi.tudelft.nl/publications_pdf/document1180.pdf.

*Primary Examiner* — Jason Uhlenhake
(74) *Attorney, Agent, or Firm* — HP Inc. Patent Department

(57) ABSTRACT

In an embodiment, a fluid ejection device includes an ink slot formed in a printhead die. The fluid ejection device also includes a printhead-integrated ink level sensor (PILS) to sense an ink level of a chamber in fluid communication with the slot, and a clearing resistor circuit disposed within the chamber to clear the chamber of ink.

19 Claims, 11 Drawing Sheets

(56) References Cited

U.S. PATENT DOCUMENTS

| | | | | |
|---|---|---|---|---|
| 6,398,329 | B1 | 6/2002 | Boyd et al. | |
| 7,461,913 | B2 | 12/2008 | Kusakari | |
| 7,543,908 | B2 * | 6/2009 | Jones | B41J 2/14112 347/26 |
| 8,657,414 | B2 * | 2/2014 | Nielsen | B41J 2/14153 347/19 |
| 2004/0012497 | A1 * | 1/2004 | Malik | B41J 2/17546 340/605 |
| 2006/0192288 | A1 * | 8/2006 | Ueno | H01L 23/5225 257/758 |
| 2007/0153032 | A1 | 7/2007 | Chou et al. | |
| 2008/0231651 | A1 | 9/2008 | Jung | |
| 2009/0322806 | A1 | 12/2009 | Donahue et al. | |
| 2010/0295884 | A1 | 11/2010 | Smektala | |
| 2014/0104333 | A1 * | 4/2014 | Gunnell | B41J 2/175 347/7 |

FOREIGN PATENT DOCUMENTS

| | | |
|---|---|---|
| TW | 200726652 A | 7/2007 |
| WO | WO-2006/072899 | 7/2006 |

* cited by examiner

FLUID EJECTION DEVICE WITH INTEGRATED INK LEVEL SENSOR

BACKGROUND

Accurate ink level sensing in ink supply reservoirs for many types of inkjet printers is desirable for a number of reasons. For example, sensing the correct level of ink and providing a corresponding indication of the amount of ink left in an ink cartridge allows printer users to prepare to replace finished ink cartridges. Accurate ink level indications also help to avoid wasting ink, since inaccurate ink level indications often result in the premature replacement of ink cartridges that still contain ink. In addition, printing systems can use ink level sensing to trigger certain actions that help prevent low quality prints that might result from inadequate supply levels.

While there are a number of techniques available for determining the level of ink in a reservoir, or fluidic chamber, various challenges remain related to their accuracy and cost.

BRIEF DESCRIPTION OF THE DRAWINGS

The present embodiments will now be described, by way of example, with reference to the accompanying drawings, in which.

DETAILED DESCRIPTION

Overview

Figure 1A:
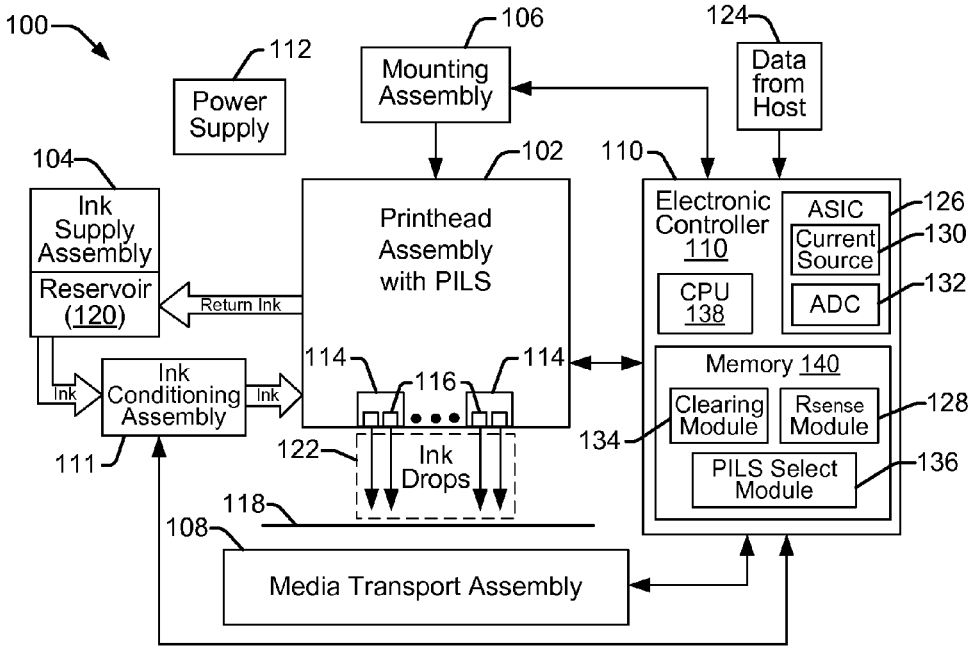
FIG. 1*a* shows an inkjet printing system suitable for incorporating a fluid ejection device comprising a printhead-integrated ink level sensor (PILS) and clearing resistor circuit as disclosed herein, according to an embodiment.

As noted above, there are a number of techniques available for determining the level of a fluid, such as ink, in a reservoir or other fluidic chamber. For example, prisms have been used to reflect or refract light beams in ink cartridges to generate electrical and/or user-viewable ink level indications. Backpressure indicators are another way to determine ink levels in a reservoir. Some printing systems count the number of ink drops ejected from inkjet print cartridges as a way of determining ink levels. Still other techniques use the electrical conductivity of the ink as an ink level indicator in printing systems. Challenges remain, however, regarding improving the accuracy and cost of ink level sensing systems and techniques.

Embodiments of the present disclosure improve on prior ink level sensors and sensing techniques, generally, through a fluid ejection device (i.e., printhead) that includes a printhead-integrated ink level sensor (PILS). The PILS employs a capacitive, charge-sharing, sense circuit along with a clearing resistor circuit to purge ink residue from the sensor chamber. One or more PILS and clearing resistor circuits are integrated on-board a thermal inkjet (TIJ) printhead die. The sense circuit implements a sample and hold technique that captures the state of the ink level through a capacitive sensor. The capacitance of the capacitive sensor changes with the level of ink. A charge placed on the capacitive sensor is shared between the capacitive sensor and a reference capacitor, causing a reference voltage at the gate of an evaluation transistor. A current source in a printer application specific integrated circuit (ASIC) supplies current at the transistor drain. The ASIC measures the resulting voltage at the current source and calculates the corresponding drain-to-source resistance of the evaluation transistor. The ASIC then determines the status of the ink level based on the resistance determined from the evaluation transistor. In one implementation, accuracy is improved through the use of multiple PILS integrated on a printhead die. A shift register serves as a selective circuit to address the multiple PILS and enable the ASIC to measure multiple voltages and determine the ink level status based on measurements taken at various locations on the printhead die.

In one example embodiment, a fluid ejection device includes an ink slot formed in a printhead die, and a printhead-integrated ink level sensor (PILS) to sense an ink level of a chamber in fluid communication with the slot. The fluid ejection device includes a clearing resistor circuit disposed within the chamber to clear the chamber of ink. In an implementation, the fluid ejection device includes multiple PILS to sense ink levels in multiple chambers in fluid communication with the slot, and a shift register to select between the multiple PILS for output onto a common ID line.

In another embodiment, a processor-readable medium stores code representing instructions that when executed by a processor cause the processor to activate a clearing resistor circuit to purge ink from a sense chamber, apply a pre-charge voltage Vp to a sense capacitor within the chamber to charge the sense capacitor with a charge Q1. The charge Q1 is shared between the sense capacitor and a reference capacitor, causing a reference voltage Vg at the gate of an evaluation transistor. A resistance is determined from drain to source of the evaluation transistor that results from Vg. In an implementation, a delay can be provided after activating the clearing resistor circuit to enable ink from a fluid slot to flow back into the sense chamber prior to applying the pre-charge voltage Vp.

In another embodiment, a processor-readable medium stores code representing instructions that when executed by a processor cause the processor to initiate the operation of multiple PILS (printhead-integrated ink level sensors) to sense an ink level at multiple areas of a fluid ejection device. A shift register on the fluid ejection device is controlled to multiplex outputs from the multiple PILS onto a common ID line.

Illustrative Embodiments

FIG. 1*a* illustrates an inkjet printing system 100 suitable for incorporating a fluid ejection device comprising a printhead-integrated ink level sensor (PILS) and clearing resistor circuit as disclosed herein, according to an embodiment of the disclosure. In this embodiment, a fluid ejection device is implemented as a fluid drop jetting printhead 114. Inkjet printing system 100 includes an inkjet printhead assembly 102, an ink supply assembly 104, a mounting assembly 106, a media transport assembly 108, an electronic controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward print media 118 so as to print onto the print media 118. Print media 118 can be any type of suitable sheet or roll material, such as paper, card stock, transparencies, polyester, plywood, foam board, fabric, canvas, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Figure 1B:
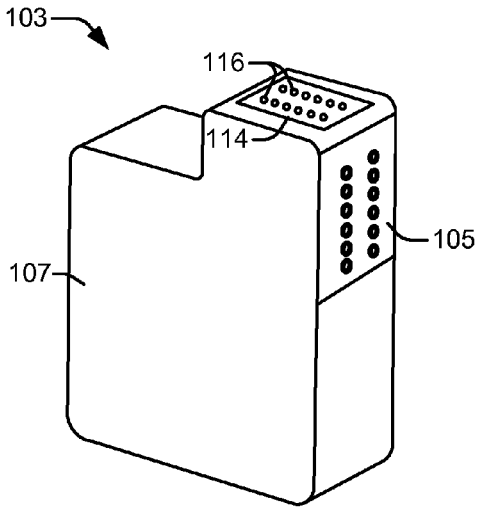
FIG. 1*b* shows a perspective view of an example inkjet cartridge that includes an inkjet printhead assembly, ink supply assembly, and reservoir, according to an embodiment.

Ink supply assembly 104 supplies fluid ink to printhead assembly 102 and includes a reservoir 120 for storing ink. In one implementation, the inkjet printhead assembly 102, ink supply assembly 104, and reservoir 120 are housed together in a replaceable device such as an integrated inkjet printhead cartridge 103, as shown in FIG. 1*b*. FIG. 1*b* shows a perspective view of an example inkjet cartridge 103 that includes inkjet printhead assembly 102, ink supply assembly 104, and reservoir 120, according to an embodiment of the disclosure. In addition to one or more printheads 114, inkjet cartridge 103 includes electrical contacts 105 and an ink (or other fluid) supply chamber 107. In some implementations cartridge 103 may have a supply chamber 107 that stores one color of ink, and in other implementations it may have a number of chambers 107 that each store a different color of ink. Electrical contacts 105 carry electrical signals to and from controller 110, for example, to cause the ejection of ink drops through nozzles 116 and make ink level measurements.

In general, ink flows from reservoir 120 to inkjet printhead assembly 102, and ink supply assembly 104 and inkjet printhead assembly 102 can form a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. Ink not consumed during printing is returned to ink supply assembly 104. Reservoir 120 of ink supply assembly 104 may be removed, replaced, and/or refilled.

In one implementation, ink supply assembly 104 supplies ink under positive pressure through an ink conditioning assembly 111 to inkjet printhead assembly 102 via an interface connection, such as a supply tube. Ink supply assembly 104 includes, for example, a reservoir, pumps and pressure regulators. Conditioning in the ink conditioning assembly 111 may include filtering, pre-heating, pressure surge absorption, and degassing. Ink is drawn under negative pressure from the printhead assembly 102 to the ink supply assembly 104. The pressure difference between the inlet and outlet to the printhead assembly 102 is selected to achieve the correct backpressure at the nozzles 116, and is usually a negative pressure between negative 1" and negative 10" of H2O.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly. As such, mounting assembly 106 includes a carriage for moving inkjet printhead assembly 102 relative to media transport assembly 108 to scan print media 118. In another implementation, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic controller 110 typically includes a processor (CPU) 138, a memory 140, firmware, software, and other electronics for communicating with and controlling inkjet printhead assembly 102, mounting assembly 106, and media transport assembly 108. Memory 140 can include both volatile (i.e., RAM) and nonvolatile (e.g., ROM, hard disk, floppy disk, CD-ROM, etc.) memory components comprising computer/processor-readable media that provide for the storage of computer/processor-executable coded instructions, data structures, program modules, and other data for inkjet printing system 100. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters from data 124. In another implementation, electronic controller 110 includes a printer application specific integrated circuit (ASIC) 126 to determine the level of ink in the fluid ejection device/printhead 114 based on resistance values from one or more printhead-integrated ink level sensors, PILS 206 (FIG. 2), integrated on the printhead die/substrate 202 (FIG. 2). Printer ASIC 126 includes a current source 130 and an analog to digital converter (ADC) 132. ASIC 126 can convert the voltage present at current source 130 to determine a resistance, and then determine a corresponding digital resistance value through the ADC 132. A programmable algorithm implemented through executable instructions within a resistance-sense module 128 in memory 140 enables the resistance determination and the subsequent digital conversion through the ADC 132. In another implementation, memory 140 of electronic controller 110 includes an ink clearing module 134 that comprises instructions executable by a processor 138 of controller 110 to activate a clearing resistor circuit on integrated printhead 114 to purge ink and/or ink residue out of a PILS chamber. In another implementation, where printhead 114 comprises multiple PILS, memory 140 of electronic controller 110 includes a PILS select module 136 executable by a processor 138 of controller 110 to control a shift register for selecting individual PILS to be used to sense ink levels.

In the described embodiments, inkjet printing system 100 is a drop-on-demand thermal inkjet printing system with a thermal inkjet (TIJ) printhead 114 (fluid ejection device) suitable for implementing a printhead-integrated ink level sensor (PILS) as disclosed herein. In one implementation, inkjet printhead assembly 102 includes a single TIJ printhead 114. In another implementation, inkjet printhead assembly 102 includes a wide array of TIJ printheads 114. While the fabrication processes associated with TIJ printheads are well suited to the integration of the PILS, other printhead types such as a piezoelectric printhead can also implement such an ink level sensor. Thus, the disclosed PILS is not limited to implementation in a TIJ printhead 114.

Figure 2A:
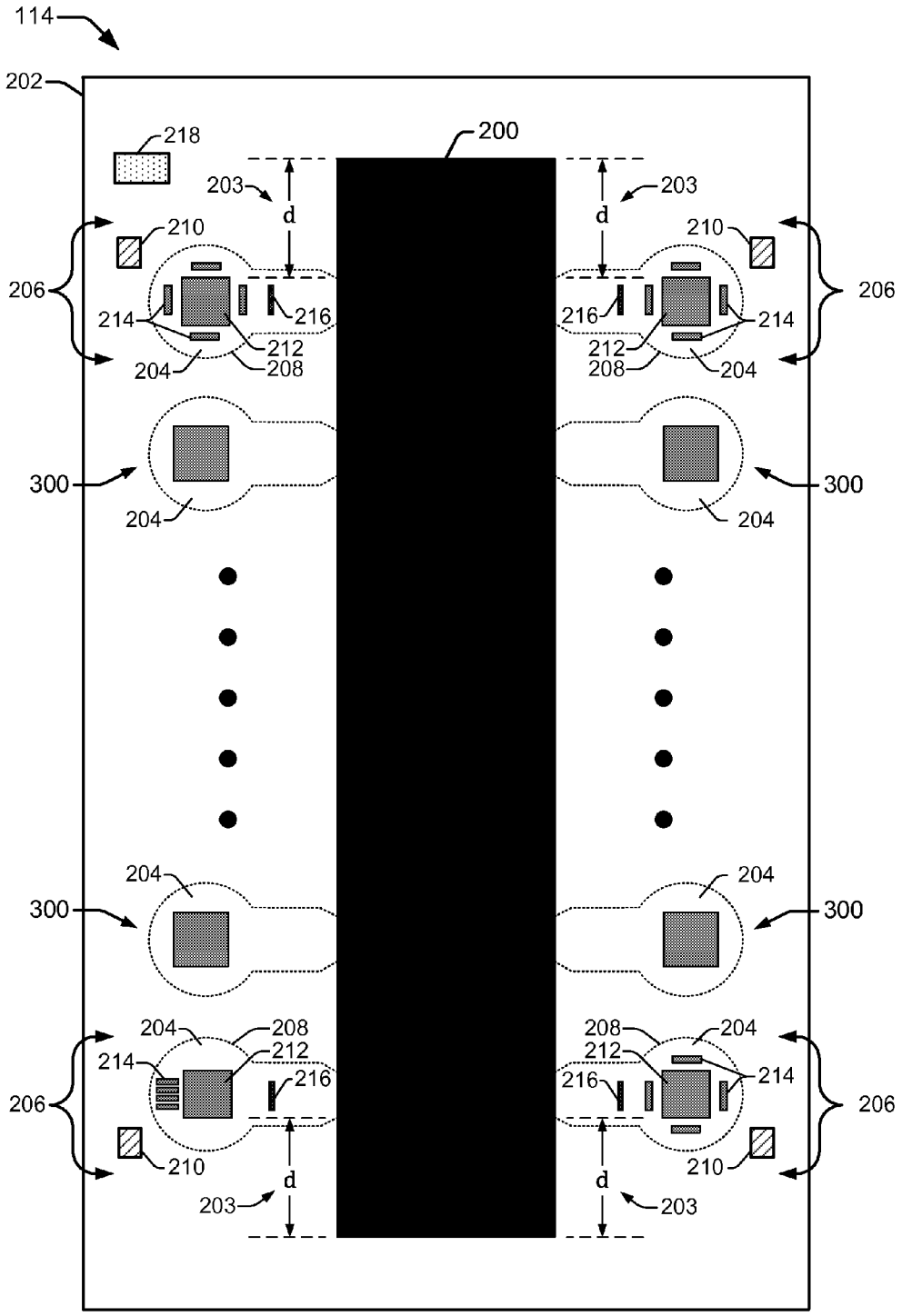
FIGS. 2*a*, 2*b*, and 2*c* show a bottom view of a TIJ printhead having a single fluid slot formed in a silicon die/substrate, according to embodiments.
Figure 2B:
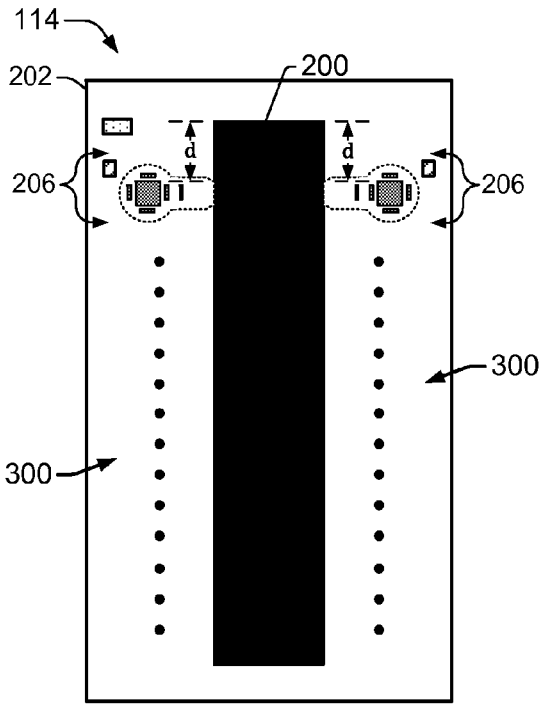
Figure 2C:
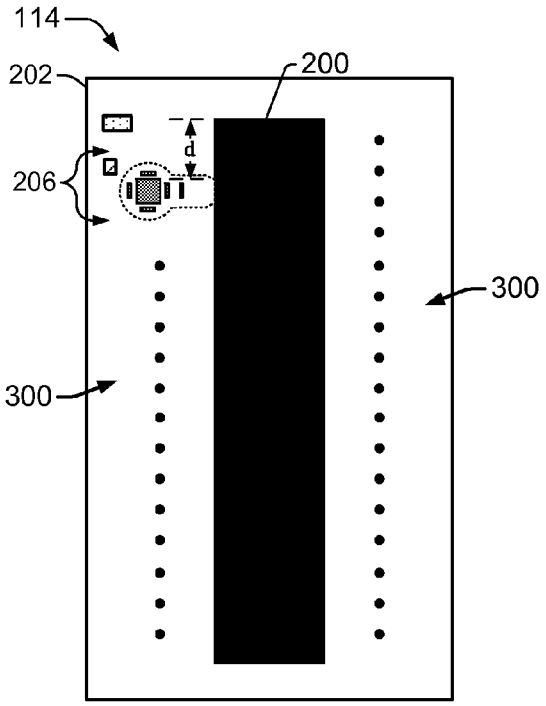

FIG. 2 (FIGS. 2*a*, 2*b*, 2*c*) shows a bottom view of a TIJ printhead 114 having a single fluid slot 200 formed in a silicon die/substrate 202, according to embodiments of the disclosure. Various components integrated on the printhead die/substrate 202 include fluid drop generators 300, one or more printhead-integrated ink level sensors (PILS) 206 and related circuitry, and a shift register 218 to enable multiplexed selection of individual PILS, as discussed in greater detail below. Although printhead 114 is shown with a single fluid slot 200, the principles discussed herein are not limited in their application to a printhead with just one slot 200. Rather, other printhead configurations are also possible, such as printheads with two or more ink slots. In the TIJ printhead 114, the die/substrate 202 underlies a chamber layer having fluid chambers 204 and a nozzle layer having nozzles 116 formed therein, as discussed below with respect to FIG. 3. However, for the purpose of illustration, the chamber layer and nozzle layer in FIG. 2 are assumed to be transparent in order to show the underlying substrate 202. Therefore, chambers 204 in FIG. 2 are illustrated using dashed lines.

The fluid slot 200 is an elongated slot formed in the substrate 202 that is in fluid communication with a fluid supply (not shown), such as a fluid reservoir 120. The fluid slot 200 has multiple fluid drop generators 300 arranged along both sides of the slot, as well as one or more PILS 206 located toward the slot ends along either side of the slot. For example, in one implementation there are four PILS 206 per slot 200, each PILS 206 located generally near one of four corners of the slot 200, toward the ends of the slot 200, as shown in FIG. 2*a*. In other implementations there can be other numbers of PILS 206 per slot, such as two PILS 206 per slot, or one PILS 206 per slot 200, as shown in FIGS. 2*b* and 2*c*, respectively. While each PILS 206 is typically located near an end-corner of a slot 200, as shown in FIG. 2, this is not intended as a limitation on other possible locations of a PILS 206. Thus, PILS 206 can be located around a slot 200 in other areas such as midway between the ends of the slot. In some embodiments a PILS 206 may even be located on one end of the slot 200 such that it extends outward from the end of the slot rather than from the side edge of the slot. However, as shown in FIG. 2, for PILS 206 located generally near end-corners of a slot 200, it may be advantageous to maintain a certain safe distance "d" 203 between the plate sense capacitor (Csense) 212 of the PILS 206 (i.e., between one edge of the plate sense capacitor 212) and the end of the slot 200. Maintaining a safe distance "d" 203 helps to ensure that there is no signal degradation from the sense capacitor (Csense) 212 due to the potential of reduced fluid flow rate that may be encountered at the ends of the slots 200. In one implementation, a safe distance "d" 203 to maintain between the plate sense capacitor (Csense) 212 and the end of the slot 200 is from about 40 microns to about 50 microns.

Figure 3:
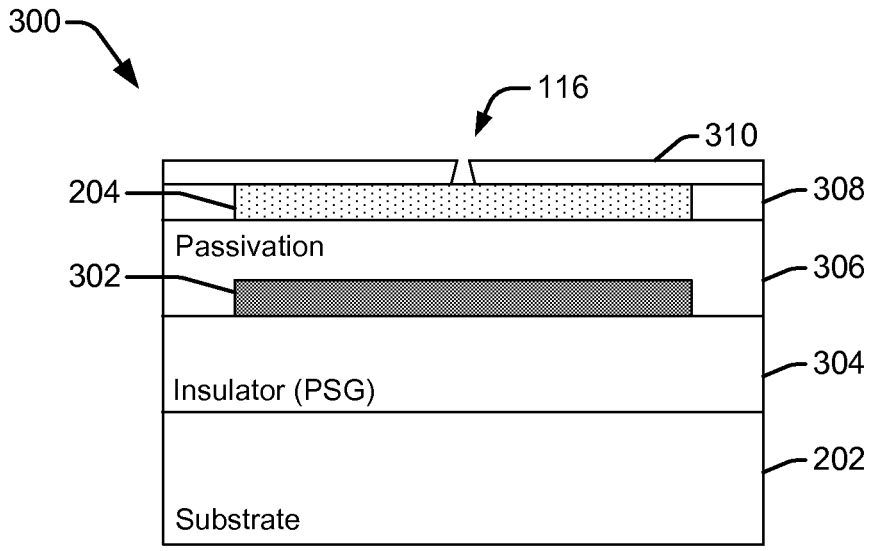
FIG. 3 shows a cross-sectional view of an example fluid drop generator, according to an embodiment.

FIG. 3 shows a cross-sectional view of an example fluid drop generator 300, according to an embodiment of the disclosure. Each drop generator 300 includes a nozzle 116, a fluid chamber 204, and a firing element 302 disposed in the fluid chamber 204. Nozzles 116 are formed in nozzle layer 310 and are generally arranged to form nozzle columns along the sides of the fluid slot 200. Firing element 302 is a thermal resistor formed of a metal plate (e.g., tantalum-aluminum, TaAl) on an insulating layer 304 (e.g., polysilicon glass, PSG) on a top surface of the silicon substrate 202. A passivation layer 306 over the firing element 302 protects the firing element from ink in chamber 204 and acts as a mechanical passivation or protective cavitation barrier structure to absorb the shock of collapsing vapor bubbles. A chamber layer 308 has walls and chambers 204 that separate the substrate 202 from the nozzle layer 310.

During operation, a fluid drop is ejected from a chamber 204 through a corresponding nozzle 116 and the chamber 204 is then refilled with fluid circulating from fluid slot 200. More specifically, an electric current is passed through a resistor firing element 302 resulting in rapid heating of the element. A thin layer of fluid adjacent to the passivation layer 306 over the firing element 302 is superheated and vaporizes, creating a vapor bubble in the corresponding firing chamber 204. The rapidly expanding vapor bubble forces a fluid drop out of the corresponding nozzle 116. When the heating element cools, the vapor bubble quickly collapses, drawing more fluid from fluid slot 200 into the firing chamber 204 in preparation for ejecting another drop from the nozzle 116.

Figure 4:
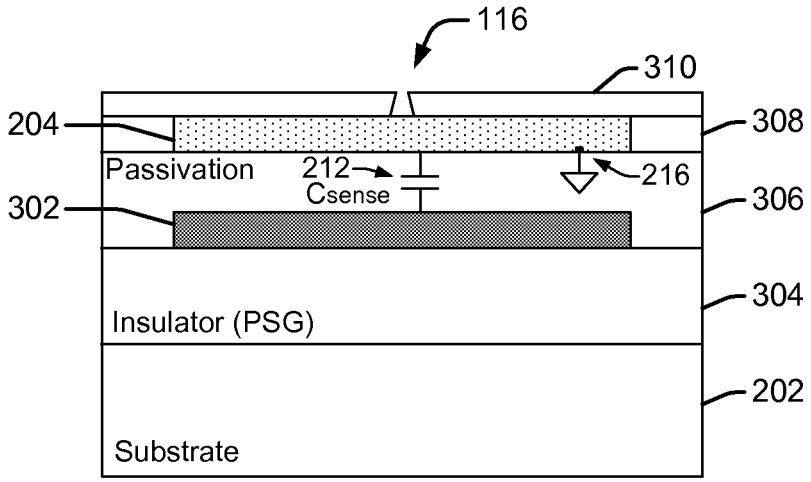
FIG. 4 shows a cross-sectional view of an example sense structure, according to an embodiment.

FIG. 4 shows a cross-sectional view of a portion of an example PILS 206, according to an embodiment of the disclosure. Referring now to both FIGS. 2 and 4, a PILS 206 generally includes a sense structure 208, sensor circuitry 210, and a clearing resistor circuit 214, integrated on the printhead 114 die/substrate 202. The sense structure 208 of PILS 206 is generally configured in the same manner as a drop generator 300, but includes a clearing resistor circuit 214 and a ground 216 to provide ground for the sense capacitor (Csense) 212 through the substance (e.g., ink, ink-air, air) in the PILS chamber 204. Therefore, like a typical drop generator 300, the sense structure 208 includes a nozzle 116, a fluid chamber 204, a conductive element such as a metal plate element 302 disposed within the fluid/ink chamber 204, a passivation layer 306 over the plate element 302, and an insulating layer 304 (e.g., polysilicon glass, PSG) on a top surface of the silicon substrate 202. However, as discussed above, a PILS 206 additionally employs a current source 130 and analog to digital convertor (ADC) 132 from a printer ASIC 126 that is not integrated onto the printhead 114. Instead, the printer ASIC 126 is located, for example, on the printer carriage or electronic controller 110 of the printer system 100.

Within the sense structure 208, a sense capacitor (Csense) 212 is formed by the metal plate element 302, the passivation layer 306, and the substance or contents of the chamber 204. The sensor circuitry 210 incorporates sense capacitor (Csense) 212 from within the sense structure 208. The value of the sense capacitor 212 changes as the substance within the chamber 204 changes. The substance in the chamber 204 can be all ink, ink and air, or just air. Thus, the value of the sense capacitor 212 changes with the level of ink in the chamber 204. When ink is present in the chamber 204, the sense capacitor 212 has good conductance to ground 216 so the capacitance value is highest (i.e., 100%). However, when there is no ink in the chamber 204 (i.e., air only) the capacitance of sense capacitor 212 drops to a very small value, which is ideally close to zero. When the chamber contains ink and air, the capacitance value of sense capacitor 212 is somewhere between zero and 100%. Using the changing value of the sense capacitor 212, the ink level sensor circuit 210 enables a determination as to the ink level. In general, the ink level in the chamber 204 is indicative of the level of ink in reservoir 120 of printer system 100.

In some implementations, a clearing resistor circuit 214 is used to purge ink and/or ink residue from the chamber 204 of the PILS sense structure 208 prior to measuring the ink level with sensor circuit 210. Thereafter, to the extent that ink is present in the reservoir 120, it flows back into the chamber to enable an accurate ink level measurement. As shown in FIG. 2, in one implementation a clearing resistor circuit 214 includes four clearing resistors surrounding the metal plate element 302 of sense capacitor (Csense) 212. Each clearing resistor is adjacent to one of the four sides of the metal plate element 302 of sense capacitor (Csense) 212. Clearing resistors comprise thermal resistors formed, for example, of tantalum-aluminum or TaAl, such as discussed above, that provide rapid heating of the ink to create vapor bubbles that force ink out of the PILS chamber 204. The clearing resistor circuit 214 purges ink from the chamber 204 and removes residual ink from the metal plate element 302 of sense capacitor (Csense) 212. Ink flowing back into the PILS chamber 204 from slot 200 then enables a more accurate sense of the ink level through sense capacitor (Csense) 212. In some implementations, a delay may be provided by controller 110 after the activation of the clearing resistor circuit 214 to provide time for ink from slot 200 to flow back into the PILS chamber prior to sensing the ink level in the PILS chamber. While the clearing resistor circuit 214 having four resistors surrounding the sense capacitor (Csense) 212 has an advantage of providing for a significant clearing of ink from the sense capacitor 212 and PILS chamber 204, other clearing resistor configurations are also contemplated that may provide clearing of ink to lesser or greater degrees. For example, a clearing resistor circuit 214 with an in-line resistor configuration is shown in the PILS 206 at the lower left of FIG. 2. In this resistor circuit 214, the clearing resistors are in-line with one another, adjacent the back edge of the metal plate element 302 of sense capacitor (Csense) 212 at the back side of the PILS chamber 204 away from the slot 200.

Figure 5:
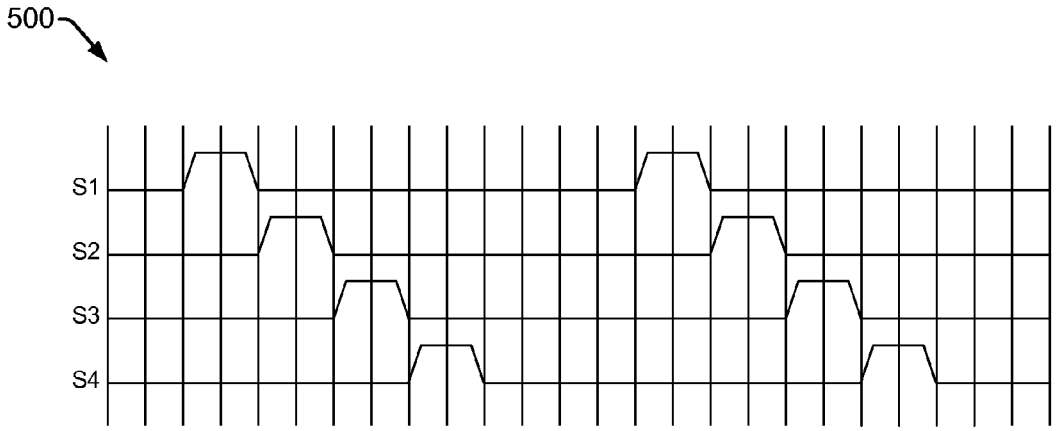
FIG. 5 shows a timing diagram of non-overlapping clock signals used to drive a printhead, according to an embodiment.

FIG. 5 shows an example of a partial timing diagram 500 having non-overlapping clock signals (S1-S4) with synchronized data and fire signals that may be used to drive a printhead 114, according to an embodiment of the disclosure. The clock signals in timing diagram 500 are also used to drive the operation of the PILS ink level sensor circuit 210 and shift register 218 as discussed below.

Figure 6:
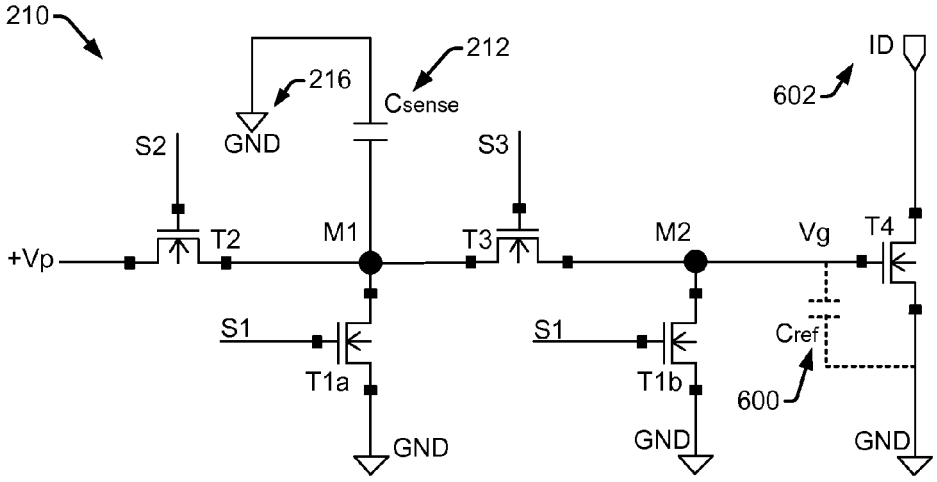
FIG. 6 shows an example ink level sensor circuit, according to an embodiment.

FIG. 6 shows an example ink level sensor circuit 210 of a PILS 206, according to an embodiment of the disclosure. In general, sensor circuit 210 employs a charge sharing mechanism to determine different levels of ink in a PILS chamber 204. Sensor circuit 210 includes two first transistors, T1 (T1*a*, T1*b*), configured as switches. Referring to FIGS. 5 and 6, during operation of the sensor circuit 210, in a first step a clock pulse S1 is used to close the transistor switches T1*a* and T1*b*, coupling memory nodes M1 and M2 to ground and discharging the sense capacitor 212 and the reference capacitor 600. Reference capacitor 600 is the capacitance between node M2 and ground. In this embodiment, reference capacitor 600 is implemented as the inherent gate capacitance of evaluation transistor T4, and it is therefore illustrated using dashed lines. Reference capacitor 600 additionally includes associated parasitic capacitance such as gate-source overlap capacitance, but the T4 gate capacitance is the dominant capacitance in reference capacitor 600. Using the gate capacitance of transistor T4 as a reference capacitor 600 reduces the number of components in sensor circuit 210 by avoiding a specific reference capacitor fabricated between node M2 and ground. However, in other embodiments, it may be beneficial to adjust the value of reference capacitor 600 through the inclusion of a specific capacitor fabricated from M2 to ground (i.e., in addition to the inherent gate capacitance of T4).

In a second step, the S1 clock pulse terminates, opening the T1*a* and T1*b* switches. Directly after the T1 switches open, an S2 clock pulse is used to close transistor switch T2. Closing T2 couples node M1 to a pre-charge voltage, Vp (e.g., on the order of +15 volts), and a charge Q1 is placed across sense capacitor 212 according to the equation, Q1=(Csense)(Vp). At this time the M2 node remains at zero voltage potential since the S3 clock pulse is off. In a third step, the S2 clock pulse terminates, opening the T2 transistor switch. Directly after the T2 switch opens, the S3 clock pulse closes transistor switch T3, coupling nodes M1 and M2 to one another and sharing the charge Q1 between sense capacitor 212 and reference capacitor 600. The shared charge Q1 between sense capacitor 212 and reference capacitor 600 results in a reference voltage, Vg, at node M2 which is also at the gate of evaluation transistor T4, according to the following equation:

$$Vg = \left(\frac{C_{sense}}{C_{sense} + C_{ref}}\right)Vp$$

Vg remains at M2 until another cycle begins with a clock pulse S1 grounding memory nodes M1 and M2. Vg at M2 turns on evaluation transistor T4, which enables a measurement at ID 602 (the drain of transistor T4). In this embodiment it is presumed that transistor T4 is biased in the linear mode of operation, where T4 acts as a resistor whose value is proportional to the gate voltage Vg (i.e., reference voltage). The T4 resistance from drain to source (coupled to ground) is determined by forcing a small current at ID 602 (i.e., a current on the order of 1 milliamp). ID 602 is coupled to a current source, such as current source 130 in printer ASIC 126. Upon applying the current source at ID, the voltage ($V_{ID}$) is measured at ID 602 by the ASIC 126. Firmware, such as Rsense module 128 executing on controller 110 or ASIC 126 can convert $V_{ID}$ to a resistance Rds from drain to source of the T4 transistor using the current at ID 602 and $V_{ID}$. The ADC 132 in printer ASIC 126 subsequently determines a corresponding digital value for the resistance Rds. The resistance Rds enables an inference as to the value of Vg based on the characteristics of transistor T4. Based on a value for Vg, a value of Csense can be found from the equation for Vg shown above. A level of ink can then be determined based on the value of Csense.

Once the resistance Rds is determined, there are various ways in which the level ink can be found. For example, the measured Rds value can be compared to a reference value for Rds, or a table of Rds values experimentally determined to be associated with specific ink levels. With no ink (i.e., a "dry" signal), or a very low ink level, the value of sense capacitor 212 is very low. This results in a very low Vg (on the order of 1.7 volts), and the evaluation transistor T4 is off or nearly off (i.e., T4 is in cut off or sub-threshold operation region). Therefore, the resistance Rds from ID to ground through T4 would be very high (e.g., with ID current of 1.2 mA, Rds is typically above 12 k ohm). Conversely, with a high ink level (i.e., a "wet" signal), the value of sense capacitor 212 is close to 100% of its value, resulting in a high value for Vg (on the order of 3.5 volts). Therefore, the resistance Rds is low. For example, with a high ink level Rds is below 1 k ohm, and is typically a few hundred ohms.

Figure 7:
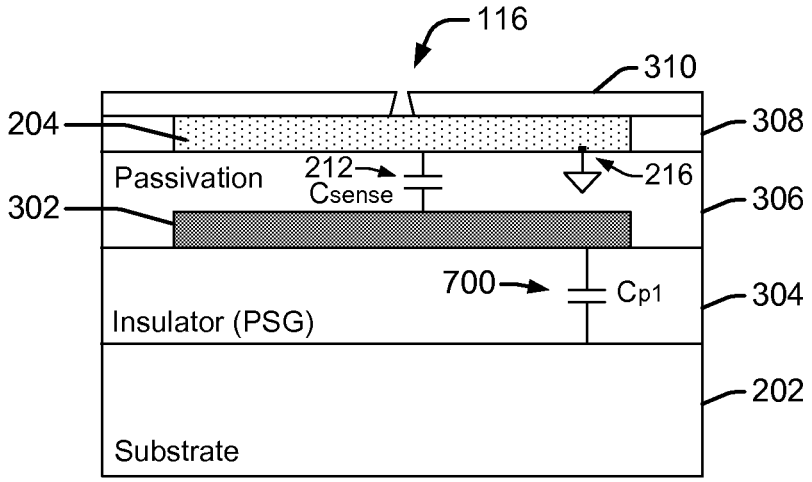
FIG. 7 shows a cross-sectional view of an example sense structure with both a sense capacitor and an intrinsic parasitic capacitance, according to an embodiment.

FIG. 7 shows a cross-sectional view of an example PILS sense structure 208 that illustrates both the sense capacitor 212 and an intrinsic parasitic capacitance Cp1 (700) underneath the metal plate 302 that forms part of sense capacitor 212, according to an embodiment of the disclosure. The intrinsic parasitic capacitance Cp1 700 is formed by the metal plate 302, the insulation layer 304, and substrate 202. As described above, a PILS 206 determines an ink level based on the capacitance value of sense capacitor 212. However, when a voltage (i.e., Vp) is applied to the metal plate 302, charging the sense capacitor 212, the Cp1 700 capacitor also charges. Because of this, the parasitic capacitance Cp1 700 can contribute on the order of 20% of the capacitance determined for sense capacitor 212. This percentage will vary depending on the thickness of the insulation layer 304 and the dielectric constant of the insulation material. However, the charge remaining in the parasitic capacitance Cp1 700 in a "dry" state (i.e., where no ink is present) is enough to turn on the evaluation transistor T4. The parasitic Cp1 700 therefore dilutes the dry/wet signal.

Figure 8:
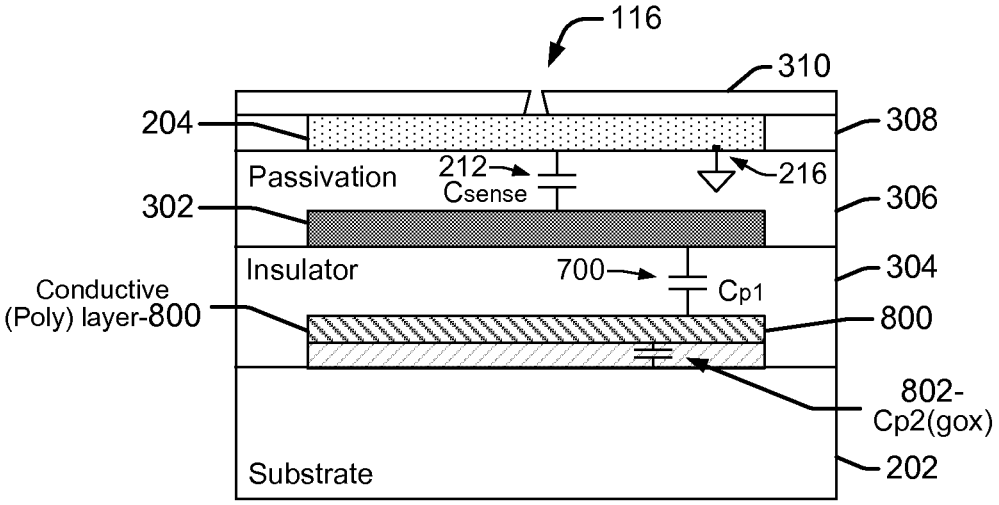
FIG. 8 shows a cross-sectional view of an example sense structure that includes a parasitic elimination element, according to an embodiment.

FIG. 8 shows a cross-sectional view of an example sense structure 208 that includes a parasitic elimination element 800, according to an embodiment of the disclosure. The parasitic elimination element is a conductive layer 800 such as a poly silicon layer designed to eliminate the impact of the parasitic capacitance Cp1 700. In this design, when a voltage (i.e., Vp) is applied to the metal plate 302, it is also applied to the conductive layer 800. This prevents a charge from developing on the Cp1 700 so that Cp1 is effectively removed/isolated from the determination of the sense capacitor 212 capacitance. Cp2, element 802, is the intrinsic capacitance from the parasitic elimination element 800 (conductive poly layer 800). Cp2 802 slows the charging speed of the parasitic elimination element 800 but has no impact on the removal/isolation of Cp1 700 because there is sufficient charge time provided for element 800.

Figure 9:
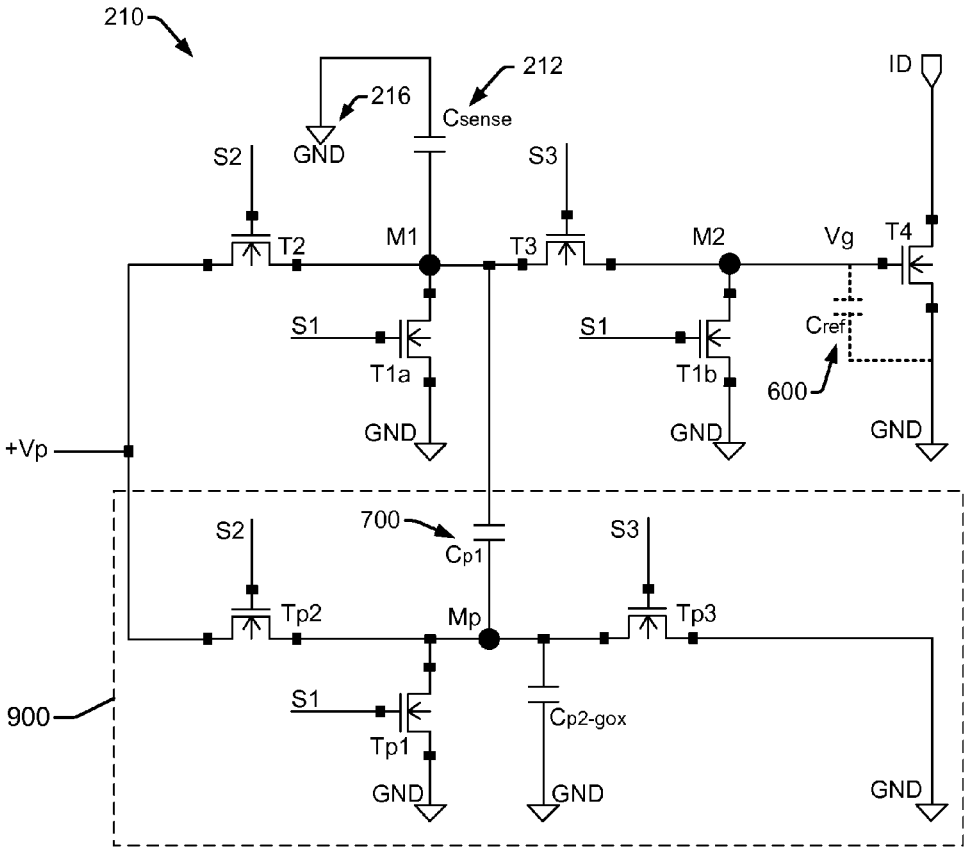
FIG. 9 shows an example ink level sensor circuit with a parasitic elimination circuit, according to an embodiment.

FIG. 9 shows an example PILS ink level sensor circuit 210 with a parasitic elimination circuit 900, according to an embodiment of the disclosure. In FIG. 9, the parasitic capacitance Cp1 700 is shown coupled between the metal plate 302 (node M1) and the conductive layer 800 (node Mp). Referring to FIGS. 8 and 9, the ink level sensor circuit 210 with parasitic elimination circuit 900 are driven by non-overlapping clock signals such as those shown in the timing diagram 500 of FIG. 5. In a first step, a clock pulse S1 is used to close the transistor switches T1*a*, T1*b* and Tp1. Closing switches T1*a*, T1*b* and Tp1 couples memory nodes M1, M2 and Mp to ground, discharging the sense capacitor (Csense) 212, the reference capacitor (Cref) 600 and the parasitic capacitor (Cp1)) 700. In a second step, the S1 clock pulse terminates, opening the T1*a*, T1*b* and Tp1 switches. Directly after the T1*a*, T1*b* and Tp1 switches open, an S2 clock pulse is used to close transistor switches T2 and Tp2. Closing T2 and Tp2 couples nodes M1 and Mp, respectively, to a pre-charge voltage, Vp. This places a charge Q1 across sense capacitor (Csense) 212. However, with nodes M1 and Mp at the same voltage potential, Vp, no charge develops across parasitic capacitor (Cp1) 700.

The ink level sensor circuit 210 then continues to function as described above with regard to FIG. 6. Thus, in a third step, the S2 clock pulse terminates, opening the T2 and Tp2 transistor switches. Directly after the T2 and Tp2 switches open, the S3 clock pulse closes transistor switches T3 and Tp3. Closing switch T3 couples nodes M1 and M2 to one another and shares the charge Q1 between sense capacitor 212 and reference capacitor 600. The shared charge Q1 between sense capacitor 212 and reference capacitor 600 results in a reference voltage, Vg, at node M2 which is also at the gate of evaluation transistor T4. Closing switch Tp3 couples parasitic capacitor (Cp1) 700 to ground. During the S3 clock pulse, parasitic charge on Cp1 700 is discharged, leaving only the sense capacitor 212 to be evaluated with the evaluation transistor T4. Since the effect of the parasitic capacitor (Cp1) 700 is removed, for a dry signal there is a much reduced parasitic contribution to turn on T4.

Figure 10:
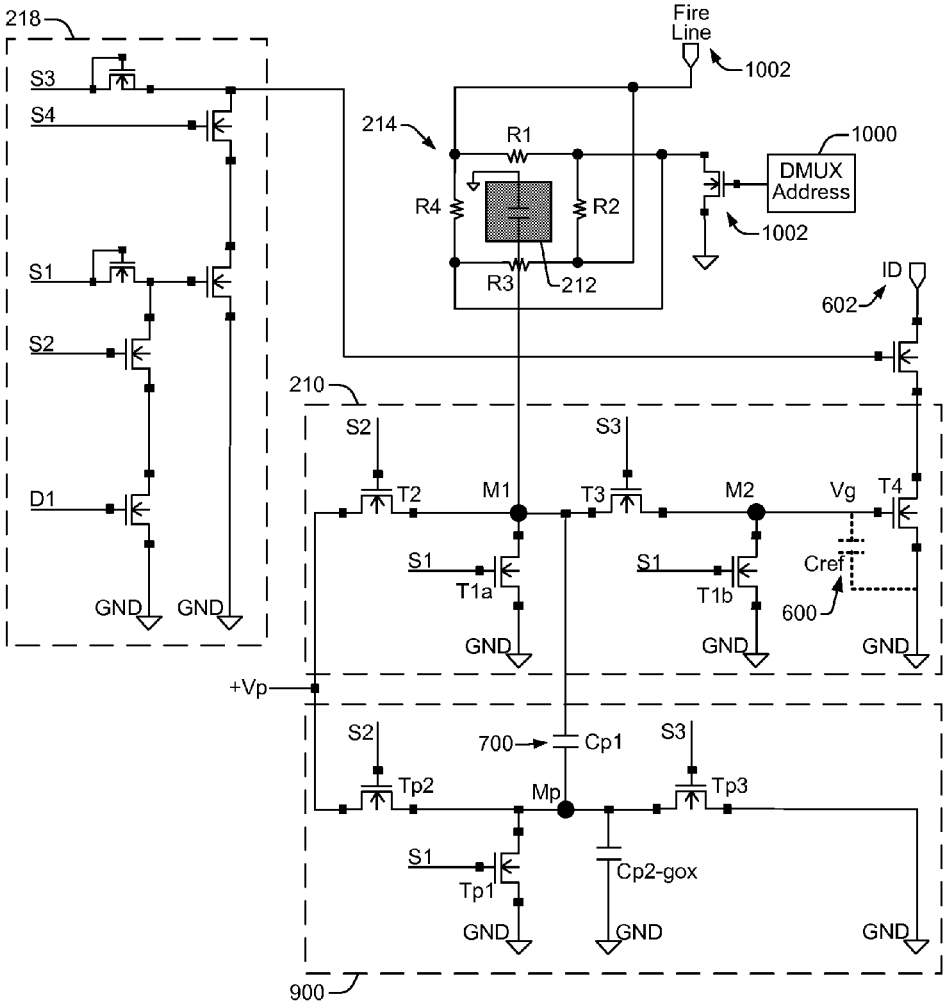
FIG. 10 shows an example PILS ink level sensor circuit with a parasitic elimination circuit, a clearing resistor circuit, and shift register, according to an embodiment.

FIG. 10 shows an example PILS ink level sensor circuit 210 with a parasitic elimination circuit 900, clearing resistor circuit 214, and shift register 218, according to an embodiment of the disclosure. As noted above, clearing resistor circuit 214 can be activated to purge ink and/or ink residue out of a PILS chamber 204 prior to measuring the sensor circuit 210 at ID 602. The clearing resistors R1, R2, R3, and R4, operate like typical TIJ firing resistors. Thus, they are addressed by dynamic memory multiplexing (DMUX) 1000 and driven by a power FET 1002 connected to a fire line 1004. Controller 110 can control activation of clearing resistor circuit 214 through fire line 1004 and DMUX 1000, by execution of particular firing instructions from clearing module 134, for example.

Figure 11:
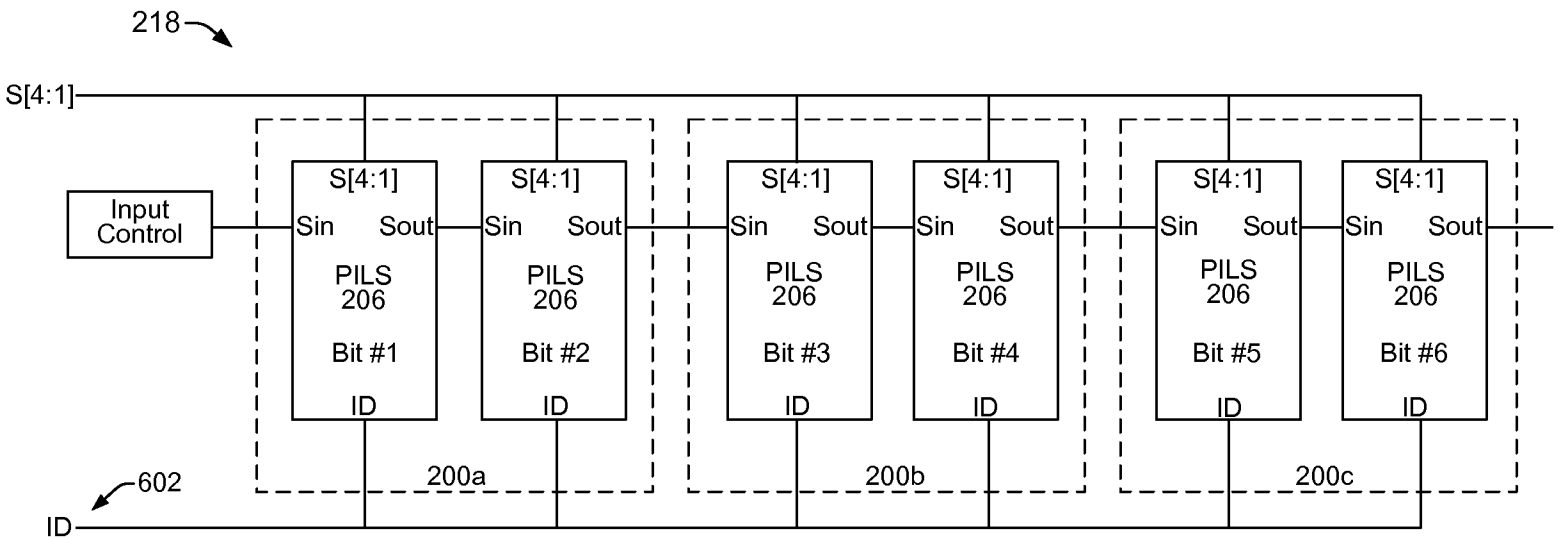
FIG. 11 shows an example of a shift register that addresses multiple PILS signals, according to an embodiment.

Typically, multiple sensor circuits 210 from multiple PILS 206 will be connected to a common ID 602 line. For example, a color printhead die/substrate 202 with several slots 200 may have twelve or more PILS 206 (i.e., four PILS per slot 200, as in FIG. 2). Shift register 218 enables multiplexing the outputs of multiple PILS sensor circuits 210 onto the common ID 602 line. A PILS select module 136 executing on controller 110 can control shift register 218 to provide a sequenced output, or other ordered output of the multiple PILS sensor circuits 210 onto common ID 602 line. FIG. 11 shows another example of a shift register 218 that addresses multiple PILS 206 signals, according to an embodiment. In FIG. 11, a shift register 218 comprises a PILS block selective circuit to address multiple PILS signals from six PILS 206. There are three slots 200 (200*a*, 200*b*, 200*c*) on a color die 202, with two PILS 206 for each slot 200. Addressing the multiple PILS signals through shift register 218 increases the accuracy of ink level measurements by checking various locations on the die. In general, by employing shift register 218, the measurement results from multiple PILS 206 can be compared, averaged, or otherwise mathematically manipulated by ASIC 126, for example, to provide greater accuracy in determining ink levels.

Figure 12:
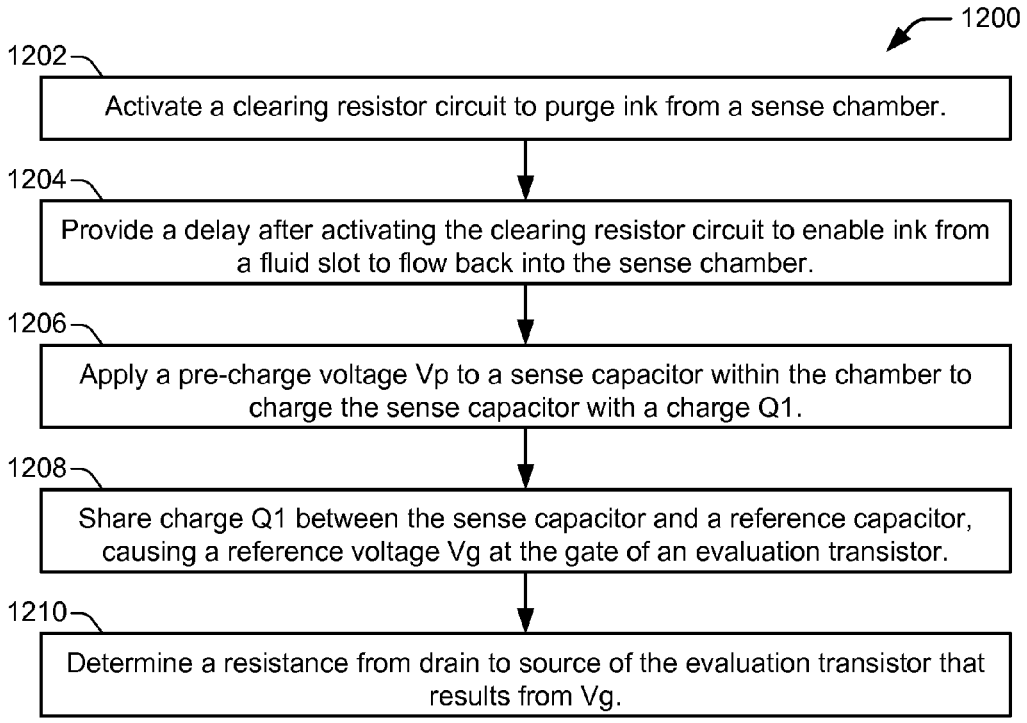
FIGS. 12 and 13 show flowcharts of example methods related to sensing an ink level with a printhead-integrated ink level sensor (PILS) of a fluid ejection device, according to embodiments.
Figure 13:
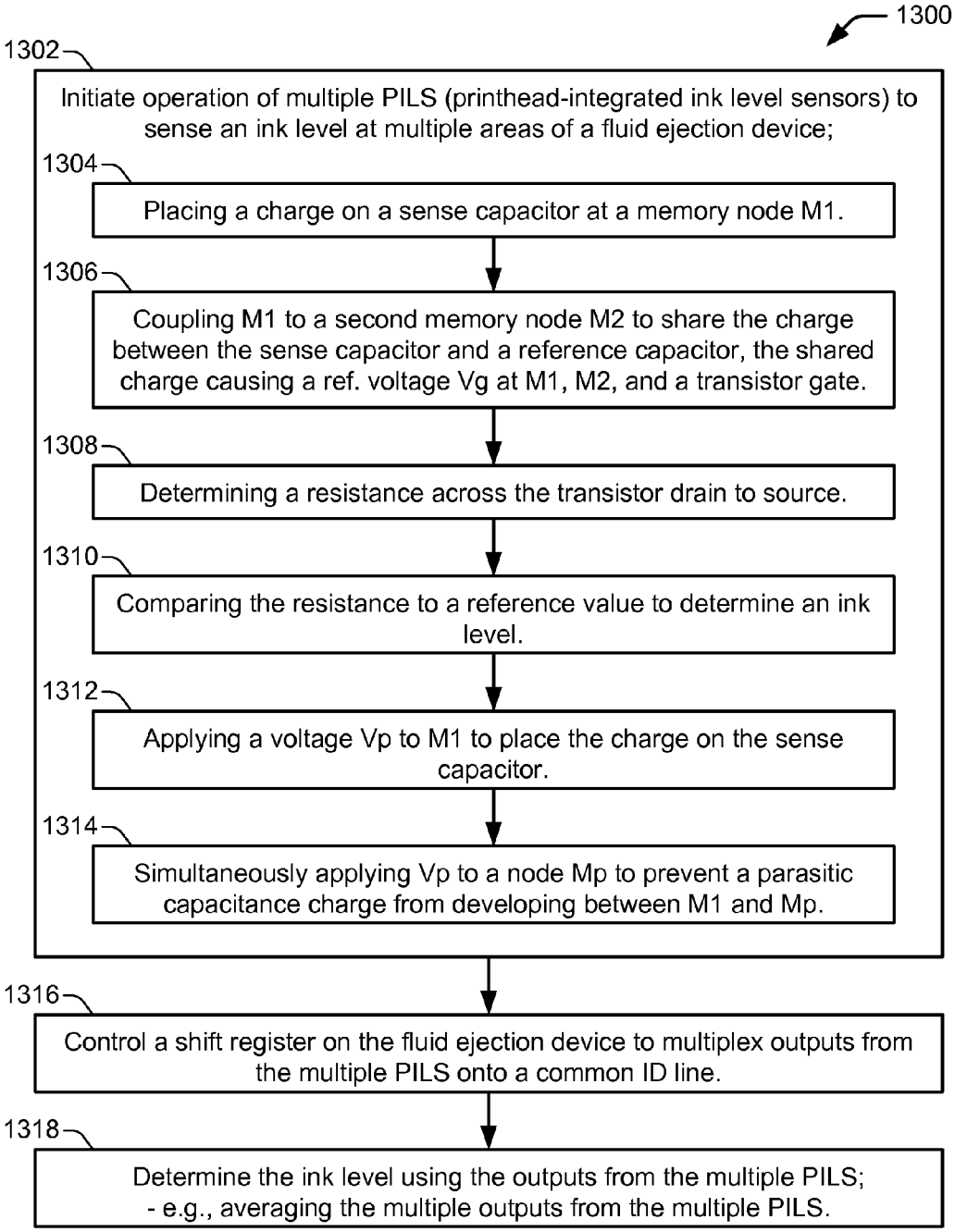

FIGS. 12 and 13 show flowcharts of example methods 1200 and 1300, that are related to sensing an ink level with a printhead-integrated ink level sensor (PILS) of a fluid ejection device, according to embodiments of the disclosure. Methods 1200 and 1300 are associated with the embodiments discussed above with regard to FIGS. 1-11, and details of the steps shown in methods 1200 and 1300 can be found in the related discussion of such embodiments. The steps of methods 1200 and 1300 may be embodied as programming instructions stored on a computer/processor-readable medium, such as memory 140 of FIG. 1. In an embodiment, the implementation of the steps of method 1200 and 1300 is achieved by the reading and execution of such programming instructions by a processor, such as processor 138 of FIG. 1. Methods 1200 and 1300 may include more than one implementation, and different implementations of methods 1200 and 1300 may not employ every step presented in the respective flowcharts. Therefore, while steps of method 1200 and 1300 are presented in a particular order, the order of their presentation is not intended to be a limitation as to the order in which the steps may actually be implemented, or as to whether all of the steps may be implemented. For example, one implementation of method 1200 might be achieved through the performance of a number of initial steps, without performing one or more subsequent steps, while another implementation of method 1200 might be achieved through the performance of all of the steps.

Method 1200 of FIG. 12, begins at block 1202, where the first step shown is to activate a clearing resistor circuit to purge ink from a sense chamber. At block 1204, the method 1200 continues with providing a delay after activating the clearing resistor circuit to enable ink from a fluid slot to flow back into the sense chamber. Method 1200 continues at block 1206 with applying a pre-charge voltage Vp to a sense capacitor within the chamber to charge the sense capacitor with a charge Q1. The charge Q1 is then shared between the sense capacitor and a reference capacitor, causing a reference voltage Vg at the gate of an evaluation transistor, as shown at block 1208. At block 1210, the method 1200 ends with determining a resistance from drain to source of the evaluation transistor that results from Vg.

Method 1300 of FIG. 13, begins at block 1302, where the first step shown is to initiate operation of multiple PILS (printhead-integrated ink level sensors) to sense an ink level at multiple areas of a fluid ejection device. The multiple PILS can be located around one or multiple fluid slots. The operation of a PILS comprises a number of steps, including placing a charge on a sense capacitor at a memory node M1, as shown at block 1304. As shown at block 1306, operation of a PILS further includes coupling M1 to a second memory node M2 to share the charge between the sense capacitor and a reference capacitor. The shared charge causes a reference voltage, Vg, at M1, M2, and at a transistor gate. A resistance is then determined across the transistor drain to source, as shown at block 1308, and at block 1310 the resistance is compared to a reference value to determine an ink level. Operation of a PILS can also include removing, or eliminating the presence of an intrinsic parasitic capacitance in the PILS. This can be achieved, as shown at blocks 1312 and 1314, by applying a voltage Vp to M1 to place the charge on the sense capacitor, and then to simultaneously apply Vp to a node Mp to prevent the parasitic capacitance charge from developing between M1 and Mp.

Method 1300 continues at block 1316 with controlling a shift register on the fluid ejection device to multiplex outputs from the multiple PILS onto a common ID line. At block 1318, the ink level can be determined by using the outputs from the multiple PILS. This is achieved, for example, by averaging the multiple outputs from the multiple PILS in an algorithm performed by ASIC 126 or controller 110.

What is claimed is:

1. A fluid ejection device comprising:
an ink slot formed in a printhead die;
a printhead-integrated ink level sensor (PILS) to sense an ink level of a chamber in fluid communication with the slot; and
a clearing resistor circuit disposed within the chamber to clear the chamber of ink.

2. A fluid ejection device as in claim 1, wherein the clearing resistor circuit comprises four resistors surrounding a sense capacitor plate of the PILS, each resistor adjacent to and aligned parallel with a different side of the sense capacitor plate.

3. A fluid ejection device as in claim 1, wherein the PILS comprises multiple PILS to sense ink levels in multiple chambers in fluid communication with the slot, the fluid ejection device further comprising:
a shift register to select between the multiple PILS for output onto a common ID line.

4. A fluid ejection device as in claim 3, wherein the multiple PILS comprise four PILS around a single slot, each of the four PILS located near a different end-corner of the slot.

5. A fluid ejection device as in claim 4, further comprising a sense capacitor plate in each PILS, wherein each sense capacitor plate is a minimum safe distance of about 40 to about 50 microns from an end of the slot.

6. A fluid ejection device as in claim 3, further comprising a controller to control activation of the clearing resistor circuit and to control the shift register to select between the multiple PILS for output onto a common ID line.

7. A fluid ejection device as in claim 1, wherein the PILS comprises:
a sense capacitor whose capacitance changes with the ink level in the chamber;
a switch T2 to apply a voltage Vp to the sense capacitor, placing a charge on the sense capacitor;
a switch T3 to share the charge between the sense capacitor and a reference capacitor, resulting in a reference voltage Vg; and
an evaluation transistor configured to provide a drain to source resistance in proportion to the reference voltage.

8. The fluid ejection device as in claim 7, further comprising:
a processor-readable medium storing code representing instructions that when executed by a processor of the fluid ejection device cause the processor to:
activate the clearing resistor circuit to purge ink from the chamber;
apply a pre-charge voltage Vp to the sense capacitor within the chamber to charge the sense capacitor with a charge Q1;
share charge Q1 between the sense capacitor and the reference capacitor, causing a reference voltage Vg at a gate of the evaluation transistor; and
determine a resistance from drain to source of the evaluation transistor that results from Vg.

9. The fluid ejection device as in claim 8, wherein the instructions further cause the processor to:

provide a delay after activating the clearing resistor circuit to enable ink from a fluid slot to flow back into the chamber prior to applying the pre-charge voltage Vp.

10. A fluid ejection device as in claim 1, further comprising a parasitic elimination circuit to eliminate intrinsic parasitic capacitance of the PILS.

11. The fluid ejection device as in claim 1, further comprising a processor-readable medium storing code representing instructions that when executed by a processor of the fluid ejection device cause the processor to:

initiate operation of multiple PILS (printhead-integrated ink level sensors) to sense an ink level at multiple areas of the fluid ejection device; and control a shift register on the fluid ejection device to multiplex outputs from the multiple PILS onto a common ID line.

12. The fluid ejection device as in claim 11, wherein the instructions further cause the processor to determine the ink level using the outputs from the multiple PILS.

13. The fluid ejection device as in claim 12, wherein determining the ink level comprises averaging the multiple outputs from the multiple PILS.

14. The fluid ejection device as in claim 11, wherein operation of a PILS comprises:

placing a charge on a sense capacitor at a memory node M1;

coupling M1 to a second memory node M2 to share the charge between the sense capacitor and a reference capacitor, the shared charge causing a reference voltage Vg at M1, M2, and a transistor gate;

determining a resistance across the transistor drain to source; and comparing the resistance to a reference value to determine an ink level.

15. The fluid ejection device as in claim 14, wherein operation of a PILS further comprises:

applying a voltage Vp to M1 to place the charge on the sense capacitor; and simultaneously applying Vp to a node Mp to prevent a parasitic capacitance charge from developing between M1 and Mp.

16. A fluid ejection device comprising:

a printhead substrate having a fluid slot formed therein;

at least one fluid drop generator integrated on the substrate, the at least one fluid drop generator having a first fluid chamber fluidly connected to the fluid slot, and the at least one drop generator to eject drops of fluid from the first fluid chamber; and at least one printhead-integrated ink level sensor integrated on the substrate, the at least one print-head integrated ink level sensor having a second fluid chamber fluidly connected to the fluid slot, and the at least one printhead-integrated ink level sensor to sense an ink level of the second fluid chamber, and a clearing resistor circuit disposed within the second fluid chamber, wherein the clearing resistor circuit is to clear the second fluid chamber of ink.

17. The fluid ejection device of claim 16, wherein the at least one printhead-integrated ink level sensor comprises:

a sense capacitor disposed within the second fluid chamber, wherein the ink level of the second fluid chamber is sensed based at least in part on a capacitance value of the sense capacitor.

18. The fluid ejection device of claim 16, wherein the at least one fluid drop generator comprises:

a nozzle formed therein and fluidly connected with the first fluid chamber; and a firing element disposed in the first fluid chamber to eject the drops of fluid from the first fluid chamber via the nozzle.

19. The fluid ejection device of claim 16, wherein the at least one printhead-integrated ink level sensor comprises a first printhead-integrated ink level sensor and a second printhead-integrated ink level sensor, and the fluid ejection device further comprises:

a shift register integrated on the printhead substrate to enable multiplexed selection of the first printhead-integrated ink level sensor and the second printhead-integrated ink level sensor.

* * * * *